US011545086B2

(12) United States Patent
Wang

(10) Patent No.: US 11,545,086 B2
(45) Date of Patent: Jan. 3, 2023

(54) SCREEN MODULE AND ELECTRONIC DEVICE

(71) Applicant: Huawei Technologies Co., Ltd., Shenzhen (CN)

(72) Inventor: Xilin Wang, Dongguan (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 32 days.

(21) Appl. No.: 17/126,705

(22) Filed: Dec. 18, 2020

(65) Prior Publication Data

US 2021/0110767 A1 Apr. 15, 2021

Related U.S. Application Data

(63) Continuation of application No. PCT/CN2019/105797, filed on Sep. 12, 2019.

(30) Foreign Application Priority Data

Sep. 14, 2018 (CN) ..... 201811073041.8

(51) Int. Cl.
*G09G 3/3225* (2016.01)
*G09G 3/3266* (2016.01)

(52) U.S. Cl.
CPC ..... *G09G 3/3225* (2013.01); *G09G 3/3266* (2013.01); *G09G 2300/0408* (2013.01);
(Continued)

(58) Field of Classification Search
CPC .. G09G 3/3225; G09G 3/3266; G09G 3/3275; G09G 2300/0408;
(Continued)

(56) References Cited

U.S. PATENT DOCUMENTS 5,940,061 A * 8/1999 Sato ..... H04N 5/66 348/E5.111
2002/0044127 A1 4/2002 Uchino et al.
(Continued)

FOREIGN PATENT DOCUMENTS

CN 1333529 A 1/2002
CN 1581277 A 2/2005
(Continued)

OTHER PUBLICATIONS

Wei, J., "Analysis of Split-screen Display of Dynamic Graphics and Its Application," The New West, The Theory, No. 10, 2014, with an English Abstract, 3 pages.

*Primary Examiner* — David Tung
(74) *Attorney, Agent, or Firm* — Conley Rose, P.C.

(57) ABSTRACT

A screen includes a screen pixel array, row and column lines, a display driver integrated circuit (DDIC) circuit, a gate driver on array (GOA) circuit, a switch circuit, and an enabling signal circuit. The DDIC circuit is disposed on a side of a screen of the electronic device, and includes output channels. Each output channel is connected to two switches, each switch is connected to one row line, the GOA circuit is connected to a column line, the enabling signal circuit is connected to the switch circuit, and the screen pixel array is connected to the row and column line. The enabling signal circuit generates an enabling signal for the switch circuit. The DDIC circuit sends to-be-displayed data to the switch circuit. The switch circuit controls the two switches to alternately operate. The GOA circuit strobes a column of pixels in the screen pixel array which displays the to-be-displayed data.

2 Claims, 7 Drawing Sheets

(52) U.S. Cl.
CPC ..... *G09G 2300/0809* (2013.01); *G09G 2310/0286* (2013.01); *G09G 2320/02* (2013.01)

(58) Field of Classification Search
CPC ... G09G 2300/0809; G09G 2310/0286; G09G 2310/0224; G09G 2310/0218; G09G 2310/0221; G09G 2310/0297; G09G 2320/02
See application file for complete search history.

(56) References Cited

U.S. PATENT DOCUMENTS

| | | | | |
|---|---|---|---|---|
| 2004/0196232 | A1 | 10/2004 | Kim et al. | |
| 2004/0239603 | A1* | 12/2004 | Toriumi | G09G 3/3688 345/89 |
| 2005/0035934 | A1 | 2/2005 | Kitani et al. | |
| 2005/0248556 | A1 | 11/2005 | Toshinaga et al. | |
| 2005/0265400 | A1* | 12/2005 | Shin | G09G 3/325 370/540 |
| 2006/0238134 | A1 | 10/2006 | Park et al. | |
| 2010/0201659 | A1 | 8/2010 | Miyake et al. | |
| 2012/0086682 | A1 | 4/2012 | Shi | |
| 2013/0093734 | A1 | 4/2013 | Wang | |
| 2014/0118327 | A1 | 5/2014 | So et al. | |
| 2015/0277651 | A1 | 10/2015 | Zhang et al. | |
| 2016/0155379 | A1 | 6/2016 | Na | |
| 2016/0321992 | A1 | 11/2016 | Kim et al. | |
| 2017/0046997 | A1 | 2/2017 | Li et al. | |
| 2017/0061872 | A1 | 3/2017 | Zhou et al. | |
| 2017/0147127 | A1 | 5/2017 | Sun | |
| 2017/0288002 | A1 | 10/2017 | Kim et al. | |
| 2017/0372664 | A1 | 12/2017 | He et al. | |
| 2018/0061307 | A1* | 3/2018 | Inoue | H01L 27/3211 |
| 2018/0137805 | A1 | 5/2018 | Zheng et al. | |
| 2018/0180961 | A1 | 6/2018 | Ha et al. | |
| 2018/0226037 | A1 | 8/2018 | Zhang et al. | |
| 2019/0043418 | A1* | 2/2019 | Rieutort-Louis | G09G 3/3225 |

FOREIGN PATENT DOCUMENTS

| | | | |
|---|---|---|---|
| CN | 102332245 | A | 1/2012 |
| CN | 102446498 | A | 5/2012 |
| CN | 103150988 | A | 6/2013 |
| CN | 103794181 | A | 5/2014 |
| CN | 103823589 | A | 5/2014 |
| CN | 104932751 | A | 9/2015 |
| CN | 105070259 | A | 11/2015 |
| CN | 105244005 | A | 1/2016 |
| CN | 106023923 | A | 10/2016 |
| CN | 106098727 | A | 11/2016 |
| CN | 107274837 | A | 10/2017 |
| CN | 107346650 | A | 11/2017 |
| CN | 108242213 | A | 7/2018 |
| JP | 2007298769 | A | 11/2007 |
| TW | 201417072 | A | 5/2014 |
| WO | 2005078697 | A1 | 8/2005 |

* cited by examiner

SCREEN MODULE AND ELECTRONIC DEVICE

CROSS-REFERENCE TO RELATED APPLICATIONS

This application is a continuation application of International Patent Application No. PCT/CN2019/105797 filed on Sep. 12, 2019, which claims priority to Chinese Patent Application No. 201811073041.8 filed on Sep. 14, 2018. The disclosures of the aforementioned applications are hereby incorporated by reference in their entireties.

TECHNICAL FIELD

Embodiments of the present disclosure relate to the field of electronic circuit technologies, and more specifically, to a screen module and an electronic device.

BACKGROUND

How to increase a screen-to-body ratio of an electronic device so that the electronic device has a larger screen area in a case of a same shape and size has been a research hotspot in the industry. Currently, a display driver integrated circuit (DDIC) circuit of a mainstream active-matrix organic light-emitting diode (AMOLED) display screen is disposed in a position of a lower frame on a front side of an electronic device, and the DDIC circuit is wired from a bottom of the display screen. However, the foregoing manner restricts further improvement of the screen-to-body ratio of the electronic device, and therefore, it is proposed in the industry that the DDIC circuit is disposed at positions of frames on two sides of the screen of the electronic device. In this case, output channels of the DDIC circuit are connected to rows of a screen pixel array through row lines in row and column lines. Therefore, the number of rows of the screen pixel array needs to be the same as the number of the output channels of the DDIC circuit. However, because the existing DDIC circuit only has a maximum number of 2000 channels, the number of rows of the screen pixel array is limited, thereby reducing a screen resolution.

SUMMARY

Embodiments of the present disclosure discloses a screen module and an electronic device, so as to improve a screen resolution.

According to a first aspect, a screen module is disclosed, where the screen module includes a screen pixel array, row and column lines, a DDIC circuit, a gate driver on array (GOA) circuit, a switch circuit, and an enabling signal circuit, the DDIC circuit and the switch circuit are disposed in a non-display area on a side of a screen of an electronic device, the GOA circuit is disposed in a non-display area on an upper edge and/or a lower edge of the electronic device, the DDIC circuit includes N output channels, the screen pixel array includes 2N rows, the switch circuit includes 2N switches, and N is an integer greater than 1, each output channel of the DDIC circuit is connected to input ends of two switches in the switch circuit, an output end of each switch in the switch circuit is connected to one of row and column lines, the GOA circuit is connected to a column line in the row and column lines, the enabling signal circuit is connected to the switch circuit, and the screen pixel array is connected to the row and column lines, the enabling signal circuit generates an enabling signal, and sends the enabling signal to the switch circuit, the DDIC circuit outputs to-be-displayed data, and sends the to-be-displayed data to the switch circuit, the switch circuit controls, based on the enabling signal, two switches connected to a same output channel in the DDIC circuit to alternately operate, and send the to-be-displayed data to the screen pixel array through the row lines in the row and column lines, the GOA circuit sequentially strobes each column of pixels in the screen pixel array, and the screen pixel array displays the to-be-displayed data. Because the number of rows of the screen pixel array may be twice the number of output channels of the DDIC circuit, the number of rows of the screen pixel array is increased, so that the screen resolution can be improved.

In one embodiment, the screen of the electronic device may include upper and lower sub-screens, and the two switches that are in the switch circuit and that are connected to the same output channel in the DDIC circuit are connected to one row line belonging to an upper sub-screen and one row line belonging to a lower sub-screen in the row and column lines, so that pixels belonging to the upper sub-screen and the lower sub-screen can be alternately strobed to ensure that the to-be-displayed data is displayed by the screen pixel array, and the number of rows of the screen pixel array is increased, thereby improving the screen resolution.

In one embodiment, the enabling signal circuit includes a trigger, and the trigger is connected to the switch circuit, and can be automatically triggered after one sub-screen is scanned, so as to pull the switch to the data channel of the other sub-screen to start scanning the other sub-screen.

In one embodiment, the two switches that are in the switch circuit and that are connected to the same output channel in the DDIC circuit are connected to one odd row line and one even row line in the row and column lines, so that pixels belonging to an odd row and an even row can be alternately strobed to ensure that the to-be-displayed data is displayed by the screen pixel array, and the number of rows of the screen pixel array is increased, thereby improving the screen resolution.

In one embodiment, the enabling signal circuit may include a frequency-halving divider, and the frequency-halving divider is connected to the DDIC circuit, the GOA circuit, and the switch circuit, for performing frequency-halving on the clock signals of the DDIC circuit, and the clock signal obtained after the frequency-halving is used as the enabling signal of the switch circuit, and the clock signal obtained after the division is used as a clock signal of the GOA circuit, so as to ensure that the DDIC circuit, the switch circuit, and the GOA circuit synchronously operate.

In one embodiment, the switch circuit may include two switch sub-circuits, each of the two switch sub-circuits includes N switches, and each output channel of the DDIC circuit is connected to one switch in each of the two switch sub-circuits, and the two switch sub-circuits may be controlled, based on an enabling signal, to alternately operate, so that pixels in rows controlled by the two switch sub-circuits are alternately strobed.

In one embodiment, the GOA circuit may include two GOA sub-circuits, one of the two GOA sub-circuits is disposed in the non-display area on the upper edge of the electronic device, and the other GOA sub-circuit is disposed in the non-display area on the lower edge of the electronic device, and the GOA sub-circuit is responsible for sequentially strobing each column of pixels in an upper half sub-screen in the screen pixel array, and the other GOA sub-circuit is for sequentially strobing each column of pixels in a lower half sub-screen in the screen pixel array. Because one GOA sub-circuit is responsible for strobing only the pixels in the half screen, the driving capability can be improved, and the display effect can be ensured.

In one embodiment, switches in one of the two switch sub-circuits are connected to row lines belonging to the upper sub-screen in the row and column lines, and switches in the other one of the two switch sub-circuits are connected to row lines belonging to the lower sub-screen in the row and column lines, so that the strobing of the pixels in the upper sub-screen and the lower sub-screen can be controlled directly by controlling the turn-on and turn-off of the two switch sub-circuits.

In one embodiment, an output end of the GOA sub-circuit is connected to an input end of the other GOA sub-circuit, and the GOA sub-circuit includes M+1 shift registers, and the other GOA sub-circuit includes M shift registers. In this way, after all of the pixels in one half of the screen are strobed, the pixels in the other half of the screen can be alternately strobed, thereby ensuring that the pixels in the entire screen can be alternately strobed. M is the number of column lines in the row and column lines.

In one embodiment, the switches in one of the two switch sub-circuits are connected to odd row lines in the row and column lines, and the switches in the other one of the two switch sub-circuits are connected to even row lines in the row and column lines, so that the strobing of the pixels in the even rows and the odd rows can be controlled directly by controlling the turn-on and turn-off of the two switch sub-circuits.

In one embodiment, output ends, in the two GOA sub-circuits, connected to a same column line are connected, so as to ensure that pixels belonging to the same column in the screen pixel array can be simultaneously strobed.

In one embodiment, the screen pixel array and the switch circuit are fabricated on the same substrate.

In one embodiment, the switch included in the switch circuit is a thin film transistor (TFT).

According to a second aspect, this application discloses an electronic device, and the electronic device includes a processor and the screen module disclosed in the first aspect or any embodiment of the first aspect, the processor is configured to send to-be-displayed data to a DDIC circuit in the screen module.

According to a third aspect, this application discloses a DDIC circuit, and the DDIC circuit has a function of performing the DDIC circuit according to the first aspect and the embodiments of the first aspect.

DESCRIPTION OF EMBODIMENTS

Embodiments of the present disclosure disclose a screen module and an electronic device, so as to improve screen resolution. The embodiments are described below in detail.

Figure 1:
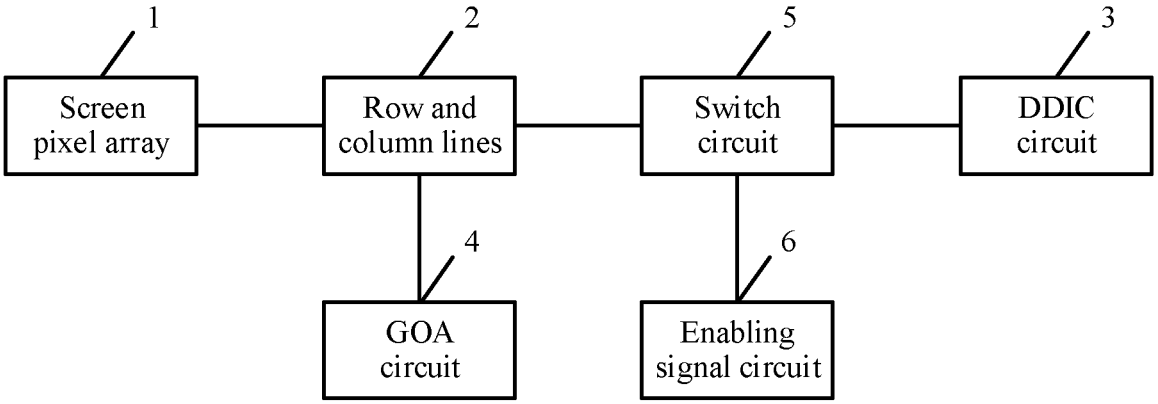
FIG. 1 is a schematic structural diagram of a screen module according to an embodiment of the present disclosure.

FIG. 1 is a schematic structural diagram of a screen module according to an embodiment of the present disclosure. As shown in FIG. 1, the screen module may include a screen pixel array 1, row and column lines 2, a DDIC circuit 3, a GOA circuit 4, a switch circuit 5, and an enabling signal circuit 6, where the DDIC circuit 3 and the switch circuit 5 are disposed in non-display areas on the side of the screen of the electronic device, the GOA circuit 4 is disposed in non-display areas on the upper edge and/or lower edge of the electronic device, the DDIC circuit 3 includes N output channels, the screen pixel array 1 includes 2N rows, the switch circuit 5 includes 2N switches, and N is an integer greater than 1, each output channel of the DDIC circuit 3 is connected to input ends of two switches in the switch circuit 5, an output end of each switch in the switch circuit 5 is connected to one row line in the row and column lines 2, the GOA circuit 4 is connected to the column lines in the row and column lines 2, the enabling signal circuit 6 is connected to the switch circuit 5, and the screen pixel array 1 is connected to the row and column lines 2, the enabling signal circuit 6 is configured to generate an enabling signal and send the enabling signal to the switch circuit 5, the DDIC circuit 3 is configured to output to-be-displayed data and send the to-be-displayed data to the switch circuit 5, the switch circuit 5 is configured to control, based on the enabling signal, two switches connected to the same output channel in the DDIC circuit 3 to alternately operate, and send to-be-displayed data to the screen pixel array 1 through the row lines in the row and column lines 2, the GOA circuit 4 is configured to sequentially strobe each column of pixels in the screen pixel array 1, and the screen pixel array 1 is configured to display the to-be-displayed data.

In this embodiment, the row lines in the row and column lines 2 are connected to pixels in the same row in the screen pixel array 1, and the column lines in the row and column lines 2 are connected to the pixels in the same column in the screen pixel array 1. The enabling signal circuit 6 generates an enabling signal, and sends the enabling signal to the switch circuit 5. The DDIC circuit 3 outputs to-be-displayed data, and sends the to-be-displayed data to the switch circuit 5. The switch circuit 5 controls, based on the enabling signal, the two switches connected to the same output channel in the DDIC circuit 3 to alternately operate, so as to strobe each row of pixels in the screen pixel array. For example, when the enabling signal is of a high level, one of the two switches operates, and when the enabling signal is of a low level, the other one of the two switches operates, and sends the to-be-displayed data to the screen pixel array 1 through the row lines in the row and column lines 2. The GOA circuit 4 sequentially strobes each column of pixels in the screen pixel array 1. The screen pixel array 1 displays the to-be-displayed data. The row line in the row and column lines may be a data line, and the column line in the row and column lines may be a scan control line.

Figure 2:
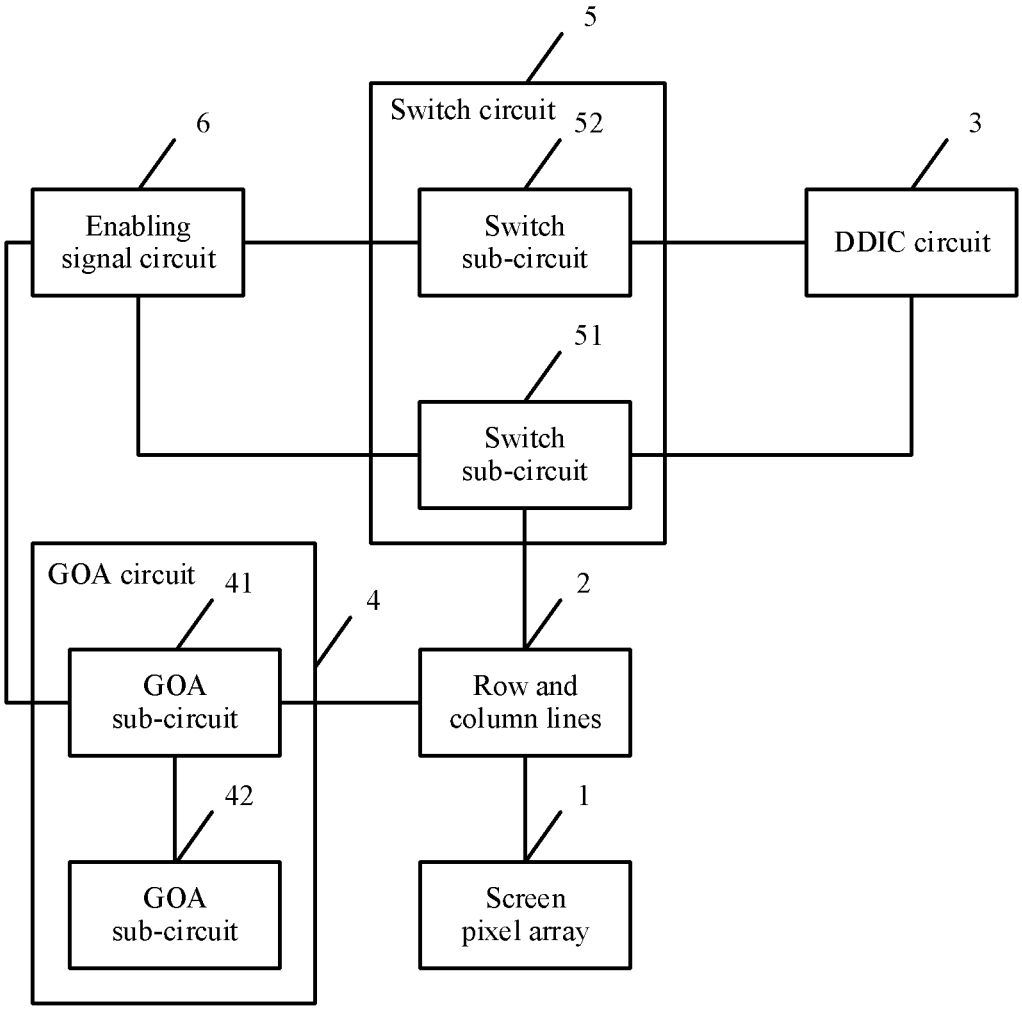
FIG. 2 is a schematic structural diagram of another screen module according to an embodiment of the present disclosure.

Based on the foregoing embodiments, FIG. 2 is a schematic structural diagram of another screen module according to an embodiment of the present disclosure. The screen module shown in FIG. 2 is obtained by optimizing the screen module shown in FIG. 1.

The screen of the electronic device may include upper and lower sub-screens, and two switches that are in the switch circuit 5 and that are connected to the same output channel in the DDIC circuit 3 are connected to one row line belonging to the upper sub-screen and one row line belonging to the lower sub-screen in the row line 2.

In a possible implementation, the enabling signal circuit 6 may include a trigger connected to the switch circuit 5.

In a possible implementation, the switch circuit 5 may include two switch sub-circuits, each of which includes N switches, and each output channel of the DDIC circuit 3 is connected to one switch in each of the two switch sub-circuits.

When being configured to control, based on the enabling signal, two switches connected to the same output channel in the DDIC circuit 3 to alternately operate, the switch circuit 5 is configured to control, based on the enabling signal, the two switch sub-circuits to alternately operate.

In a possible implementation, the GOA circuit 4 may include two GOA sub-circuits, one GOA sub-circuit 41 in the two GOA sub-circuits may be disposed in the non-display area on the upper edge of the electronic device, the other GOA sub-circuit 42 may be disposed in the non-display area on the lower edge of the electronic device, the GOA sub-circuit 41 is responsible for sequentially strobing each column of pixels in the upper half of the screen pixel array, and the other GOA sub-circuit 42 is responsible for sequentially strobing each column of pixels in the lower half of the screen pixel array.

In a possible implementation, the GOA circuit 4 may include two GOA sub-circuits, one GOA sub-circuit 41 in the two GOA sub-circuits may be disposed in the non-display area on the lower edge of the electronic device, the other GOA sub-circuit 42 may be disposed in the non-display area on the upper edge of the electronic device, the GOA sub-circuit 41 is responsible for sequentially strobing each column of pixels in the lower sub-screen in the screen pixel array, and the other GOA sub-circuit 42 is responsible for sequentially strobing each column of pixels in the upper sub-screen in the screen pixel array.

In a possible implementation, the switches in one switch sub-circuit 51 in the two switch sub-circuits are connected to the row lines belonging to the upper sub-screen in the row and column lines 2, and the switches in the other switch sub-circuit 52 in the two switch sub-circuits are connected to the row lines belonging to the lower sub-screen in the row and column lines 2.

In a possible implementation, the output end of the GOA sub-circuit 41 is connected to the input end of the other GOA sub-circuit 42 and the output end of the enabling signal circuit 6, the GOA sub-circuit 41 includes M+1 shift registers, the other GOA sub-circuit 42 includes M shift registers, and M is the number of column lines in the row and column lines.

In a possible implementation, the screen pixel array 1 and the switch circuit 5 are fabricated on the same substrate.

In a possible implementation, the switch included in the switch circuit 5 is a TFT.

In this embodiment, when the switch circuit includes two switch sub-circuits, each data line at the output end of the DDIC is of a Y-shaped trace. When the GOA circuit includes two GOA sub-circuits, the two GOA sub-circuits are respectively disposed in the non-display area on the upper edge of the electronic device and the non-display area on the lower edge of the electronic device. When the lower half screen is scanned after the upper half screen is first scanned, the GOA sub-circuit disposed on the upper edge of the electronic device includes M+1 shift registers, the GOA sub-circuit disposed on the lower edge of the electronic device includes M shift registers, the two GOA sub-circuits are cascaded, the output end of the GOA sub-circuit including the M+1 shift registers is connected to the GOA sub-circuit including the M shift registers, and the output end of the GOA sub-circuit including the M+1 shift registers is connected to the enabling signal circuit. Because the $(M+1)^{th}$ shift register does not need to scan the screen, it does not need to be connected to any column line in the row and column lines, and it is used to reserve one clock cycle for switching between the two switch sub-circuits.

Figure 4:
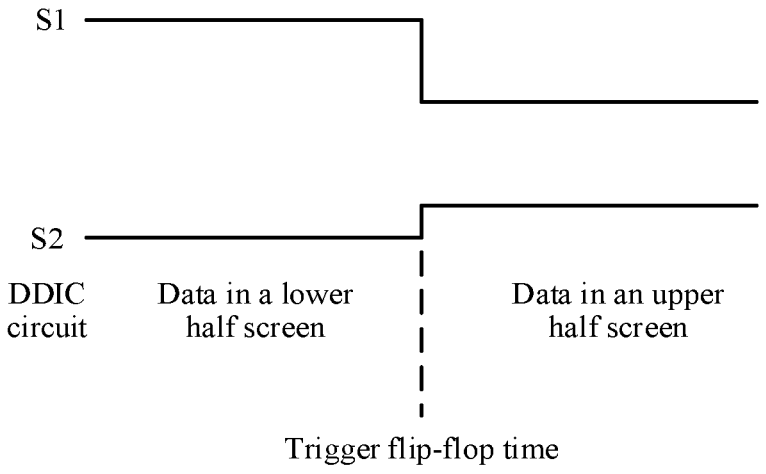
FIG. 4 is a schematic diagram of separate scanning on an upper screen and a lower screen according to an embodiment of the present disclosure.
Figure 5:
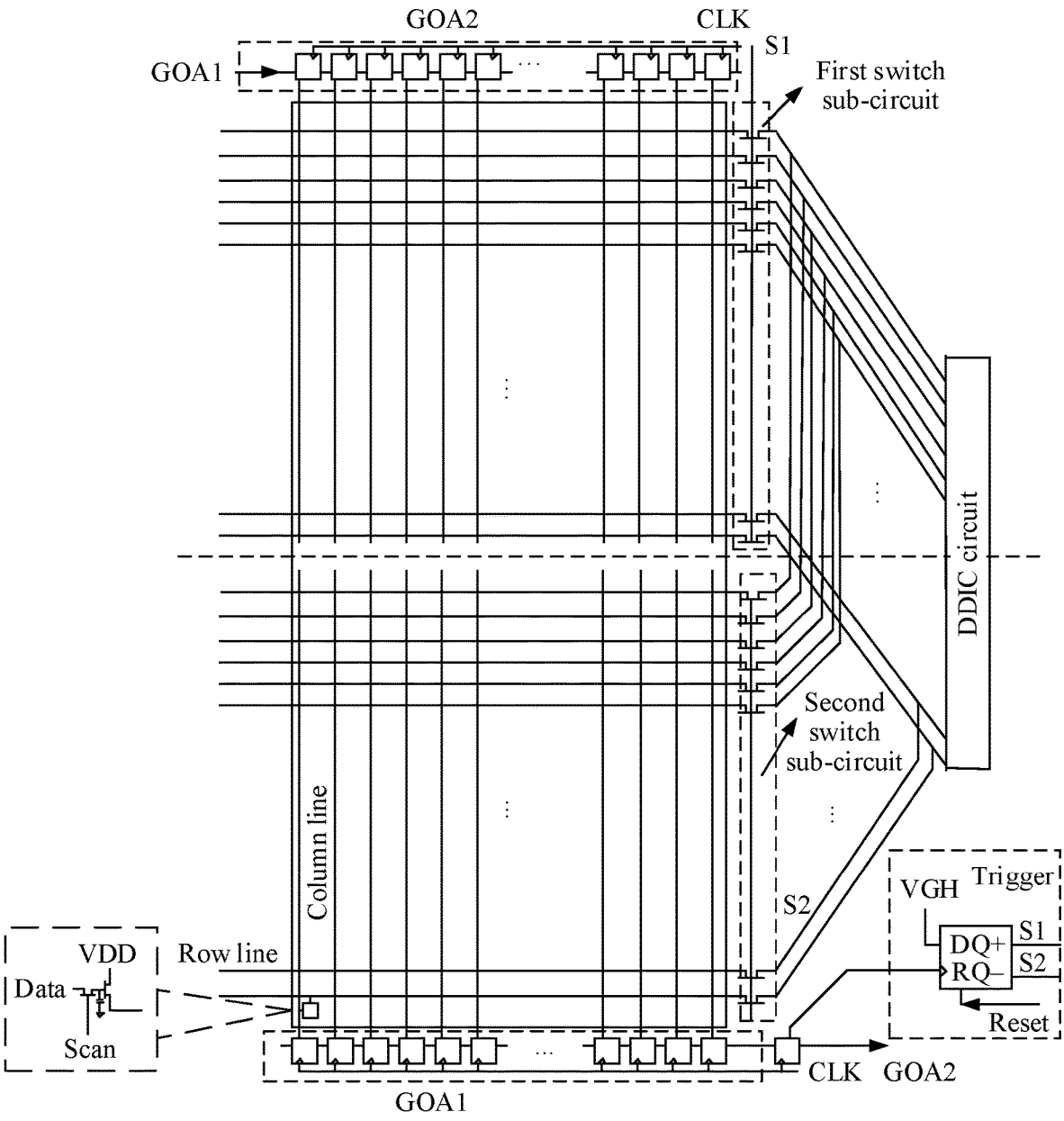
FIG. 5 is a schematic structural diagram of still another screen module according to an embodiment of the present disclosure.

In this embodiment, when the switch circuit includes two switch sub-circuits, and the GOA circuit includes two GOA sub-circuits, the data input end of the trigger is fixedly connected to a high level, the reset end of the trigger is connected to the clock output end of the DDIC circuit, the first output end of the trigger is connected to the first switch sub-circuit, and the second output end of the trigger is connected to the second switch sub-circuit. When the first output end of the trigger is of a high level, the first switch sub-circuit operates, and the first switch sub-circuit strobes the connected row line and sends to-be-displayed data from the DDIC circuit to the screen pixel array, and the corresponding GOA sub-circuits synchronously and sequentially strobe the connected column lines, so that the screen pixel array displays the to-be-displayed data. When all column lines are strobed by the GOA sub-circuit, the $(M+1)^{th}$ shift register outputs a high level, so that the trigger is inverted. In this case, the second output end of the trigger is of a high level, the second switch sub-circuit operates, and the second switch sub-circuit strobes the connected row line to send the to-be-displayed data from the DDIC circuit to the screen pixel array. In addition, the corresponding GOA sub-circuit sequentially strobes the connected column lines. When all column lines are strobed by the GOA sub-circuit, the DDIC circuit generates a reset signal to reset the trigger, that is, the first output end of the trigger is switched from a low level to a high level, and the second output end of the trigger is switched from a high level to a low level, so as to start scanning of the next cycle. FIG. 4 is a schematic diagram of separate scanning on an upper screen and a lower screen according to an embodiment of the present disclosure. As shown in FIG. 4, S1 is the first output end of the trigger, and S2 is the second output end of the trigger. When S1 is of a high level, the first switch sub-circuit operates, and when S2 is of a high level, the second switch sub-circuit operates. FIG. 5 is a schematic structural diagram of still another screen module according to an embodiment of the present disclosure. FIG. 5 shows a screen module corresponding to FIG. 4. As shown in FIG. 5, S1 is connected to the first switch sub-circuit, and S2 is connected to the second switch sub-circuit, the GOA circuit includes two sub-circuits GOA1 and GOA2, and the output end of the $(M+1)^{th}$ shift register in GOA1 is connected to both the input end of GOA2 and the trigger. The output end of the clock signal of the DDIC circuit is directly connected to the input end of the clock signal of the GOA circuit. The output end of the clock signal of the DDIC circuit may be directly or indirectly connected to the input end of the trigger. It can be seen that the DDIC circuit directly or indirectly provides control signals to the enabling signal circuit, the switch circuit, and the GOA circuit to control operation of the enabling signal circuit, the switch circuit, and the GOA circuit.

Figure 3:
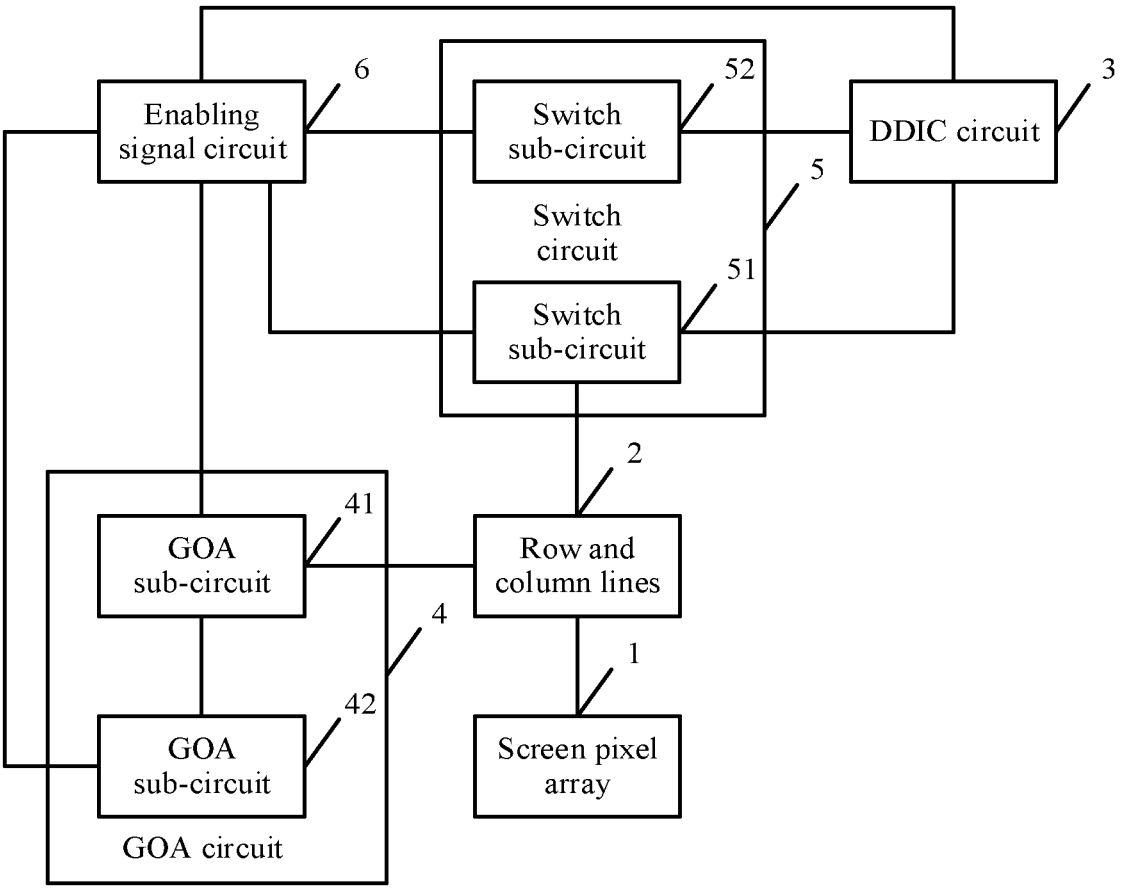
FIG. 3 is a schematic structural diagram of still another screen module according to an embodiment of the present disclosure.

Based on the foregoing embodiments, FIG. 3 is a schematic structural diagram of still another screen module according to an embodiment of the present disclosure. The screen module shown in FIG. 3 is obtained by optimizing the screen module shown in FIG. 1.

Two switches in the switch circuit 5 connected to the same output channel in the DDIC circuit 3 are respectively connected to an odd row line and an even row line in the row and column lines 2.

In a possible implementation, the enabling signal circuit 6 may include a frequency-halving divider, and the frequency-halving divider is connected to the DDIC circuit 3, the GOA circuit 4, and the switch circuit 5 for performing frequency-halving on the clock signals of the DDIC circuit 3, and the clock signal obtained after the frequency-halving is used as the enabling signal of the switch circuit 5, and the clock signal obtained after the frequency-halving is used as the clock signal of the GOA circuit 4.

In this embodiment, the frequency-halving divider may divide the clock signals of the DDIC circuit 3, and the clock signal obtained after the frequency-halving is used as the enabling signal of the switch circuit 5 and the clock signal of the GOA circuit 4. It can be seen that the DDIC circuit 3 directly or indirectly provides control signals to the enabling signal circuit 6, the switch circuit 5, and the GOA circuit 4 to control operation of the enabling signal circuit 6, the switch circuit 5, and the GOA circuit 4.

In a possible implementation, the switch circuit 5 may include two switch sub-circuits, each of which includes N switches, and each output channel of the DDIC circuit 3 is connected to one switch in each of the two switch sub-circuits.

That the switch circuit 5 controls, based on the enabling signal, two switches connected to the same output channel in the DDIC circuit to alternately operate includes control, based on the enabling signal, the two switch sub-circuits to alternately operate.

In a possible implementation, the GOA circuit 4 may include two GOA sub-circuits, one GOA sub-circuit 41 in the two GOA sub-circuits may be disposed in the non-display area on the upper edge of the electronic device, the other GOA sub-circuit 42 may be disposed in the non-display area on the lower edge of the electronic device, the GOA sub-circuit 41 is responsible for sequentially strobing each column of pixels in the upper half of the screen pixel array, and the other GOA sub-circuit 42 is responsible for sequentially strobing each column of pixels in the lower half of the screen pixel array.

In a possible implementation, the switches in one switch sub-circuit 51 in the two switch sub-circuits are connected to odd row lines in the row and column lines, and the switches in the other switch sub-circuit 52 in the two switch sub-circuits are connected to even row lines in the row and column lines.

In a possible implementation, the switches in one switch sub-circuit 51 in the two switch sub-circuits are connected to even row lines in the row and column lines, and the switches in the other switch sub-circuit 52 in the two switch sub-circuits are connected to odd row lines in the row and column lines.

In a possible implementation, the output ends of the two GOA sub-circuits connected to the same column line are connected.

In a possible implementation, the screen pixel array 1 and the switch circuit 5 are fabricated on the same substrate.

In a possible implementation, the switch included in the switch circuit 5 is a TFT.

In this embodiment, when the switch circuit includes two switch sub-circuits, each data line at the output end of the DDIC is of a Y-shaped trace. When the GOA circuit includes two GOA sub-circuits, the two GOA sub-circuits are respectively disposed in the non-display area on the upper edge of the electronic device and the non-display area on the lower edge of the electronic device. Both GOA sub-circuits include M shift registers, and both GOA sub-circuits can avoid attenuation due to an excessively long trace during column line scanning.

Figure 6:
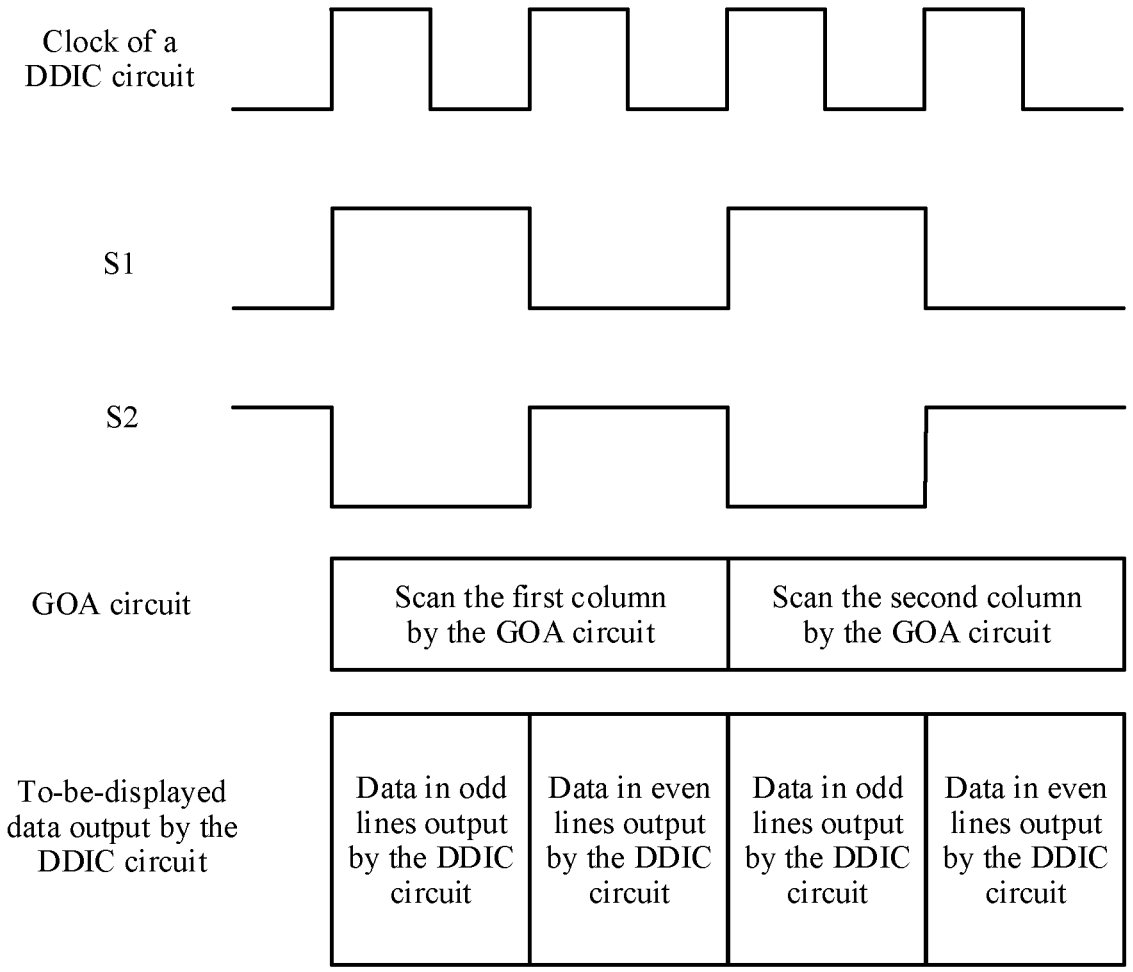
FIG. 6 is a schematic diagram of separate scanning on odd lines and even lines according to an embodiment of the present disclosure.
Figure 7:
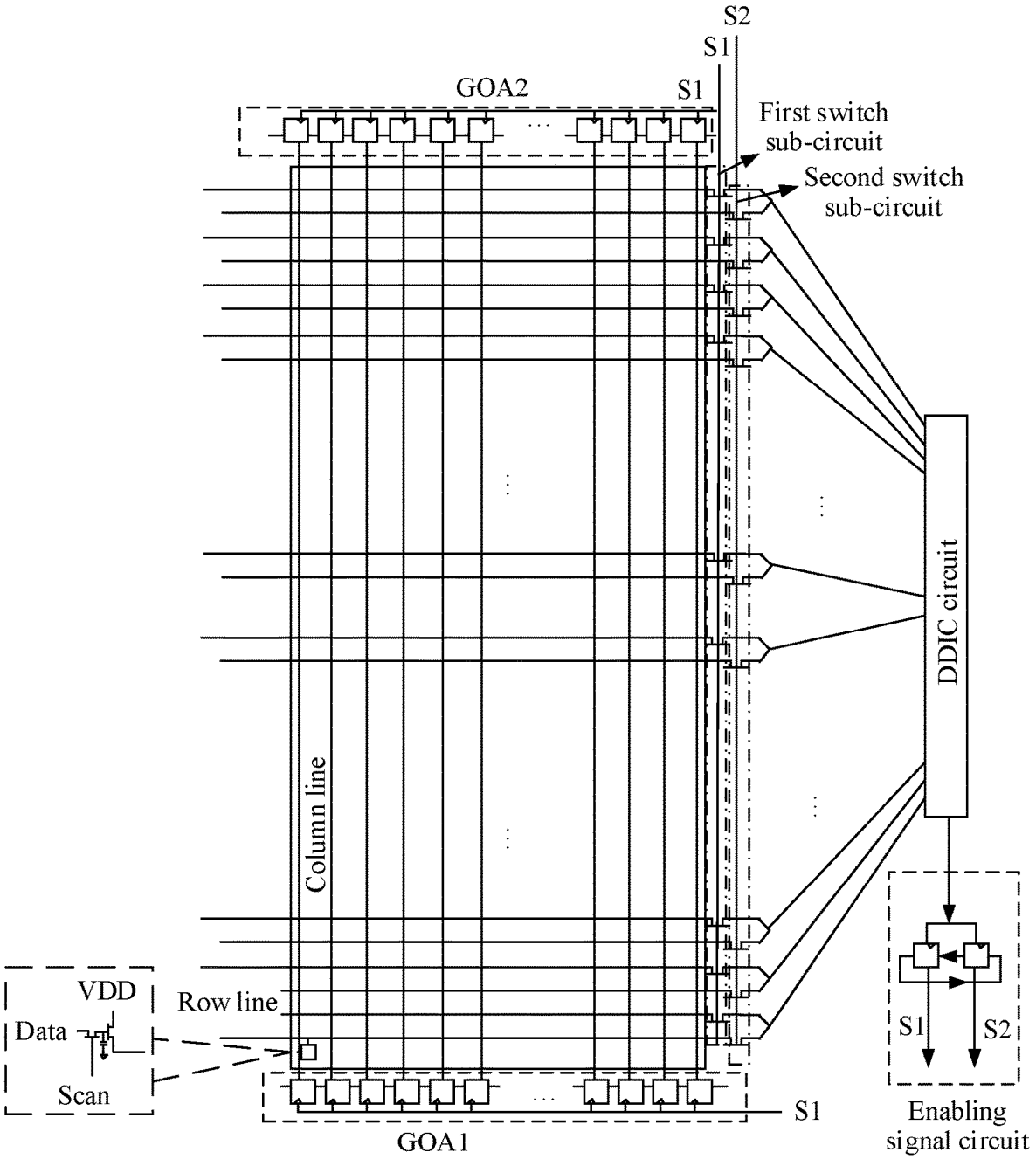
FIG. 7 is a schematic structural diagram of still another screen module according to an embodiment of the present disclosure.

In this embodiment, when the switch circuit includes two switch sub-circuits and the GOA circuit includes two GOA sub-circuits, the first output end of the frequency-halving divider is connected to the first switch sub-circuit, and the second output end of the frequency-halving divider is connected to the second switch sub-circuit. The frequency-halving divider may include two triggers. The two triggers are connected end to end. The initial values of the two triggers may be 0 and 1, respectively. The output end of one trigger is connected to the first switch sub-circuit, and the output end of the other trigger is connected to the second switch sub-circuit. Alternatively, the frequency-halving divider may include only one trigger, provided that the input end D is connected to the reverse output end/Q, and the forward output end Q is connected to the first switch sub-circuit, and the reverse output end/Q is connected to the second switch sub-circuit. When the enabling signal of the first switch sub-circuit is of a high level, the first switch sub-circuit operates, and the first switch sub-circuit strobes the connected row line and sends to-be-displayed data from the DDIC circuit to the screen pixel array, and the two GOA sub-circuits synchronously and sequentially strobe the connected column lines. When the enabling signal of the second switch sub-circuit is of a high level, the second switch sub-circuit operates, and the second switch sub-circuit strobes the connected row line and sends the to-be-displayed data from the DDIC circuit to the screen pixel array, and the two GOA sub-circuits synchronously and sequentially strobe the connected column lines, so that the screen pixel array displays the to-be-displayed data. FIG. 6 is a schematic diagram of separate scanning on odd lines and even lines according to an embodiment of the present disclosure. As shown in FIG. 6, S1 is the first output end of the trigger, and S2 is the second output end of the trigger. When S1 is of a high level, the first switch sub-circuit operates, and when S2 is of a high level, the second switch sub-circuit operates. FIG. 7 is a schematic structural diagram of still another screen module according to an embodiment of the present disclosure. FIG. 7 shows a screen module corresponding to FIG. 6. As shown in FIG. 7, S1 is connected to a first switch sub-circuit, and the first switch sub-circuit is connected to an odd row line, S2 is connected to a second switch sub-circuit, and the second switch sub-circuit is connected to an even row line, the GOA circuit includes two sub-circuits GOA1 and GOA2, and the frequency-halving divider includes two triggers.

Figure 8:
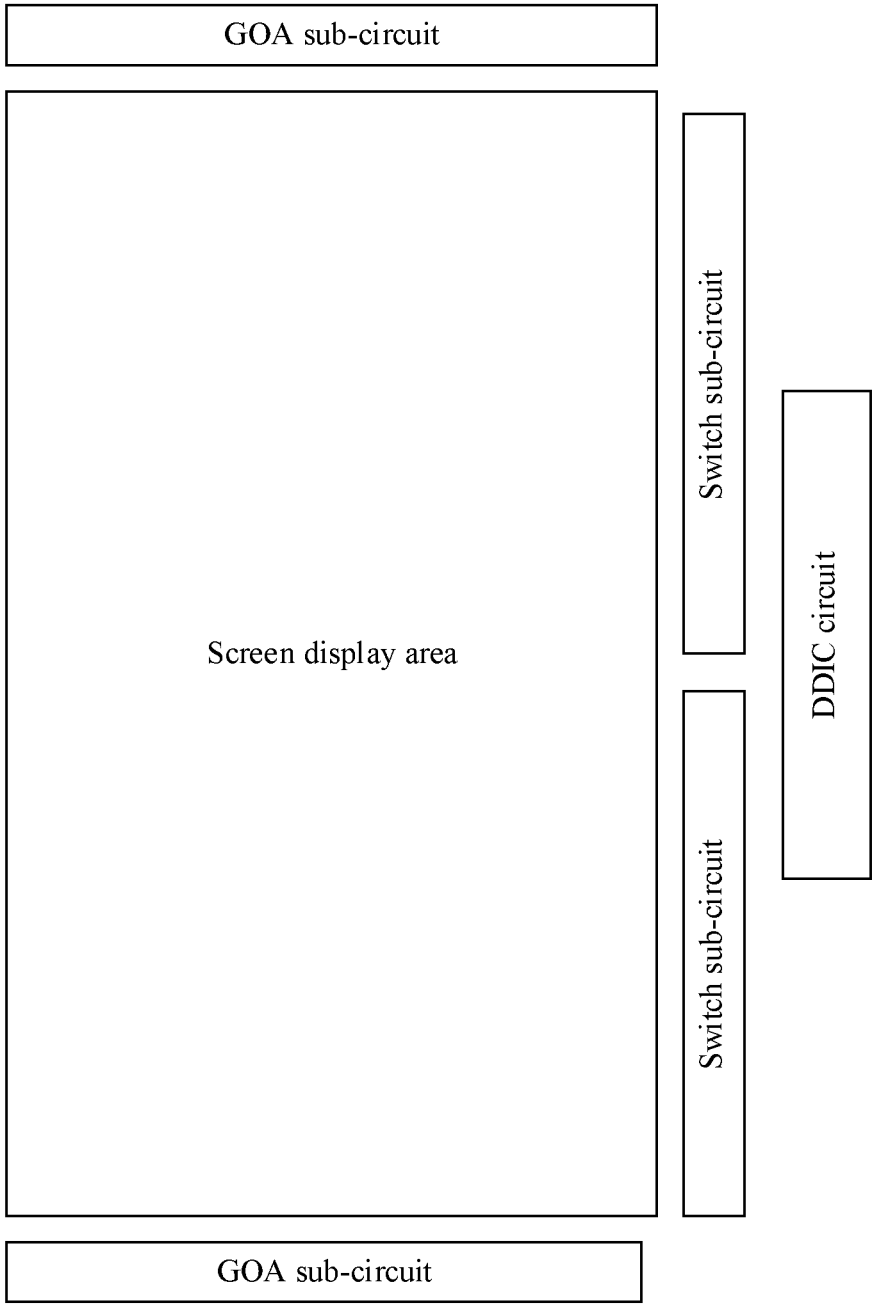
FIG. 8 is a schematic plan view of a screen module according to an embodiment of the present disclosure.

Based on the foregoing embodiments, FIG. 8 is a schematic plan view of a screen module according to an embodiment of the present disclosure. As shown in FIG. 8, the DDIC circuit and two switch sub-circuits are disposed in the non-display area on the right side of the electronic device, and the two GOA sub-circuits are respectively disposed in the non-display area on the upper edge of the electronic device and the non-display area on the lower edge of the electronic device.

Figure 9:
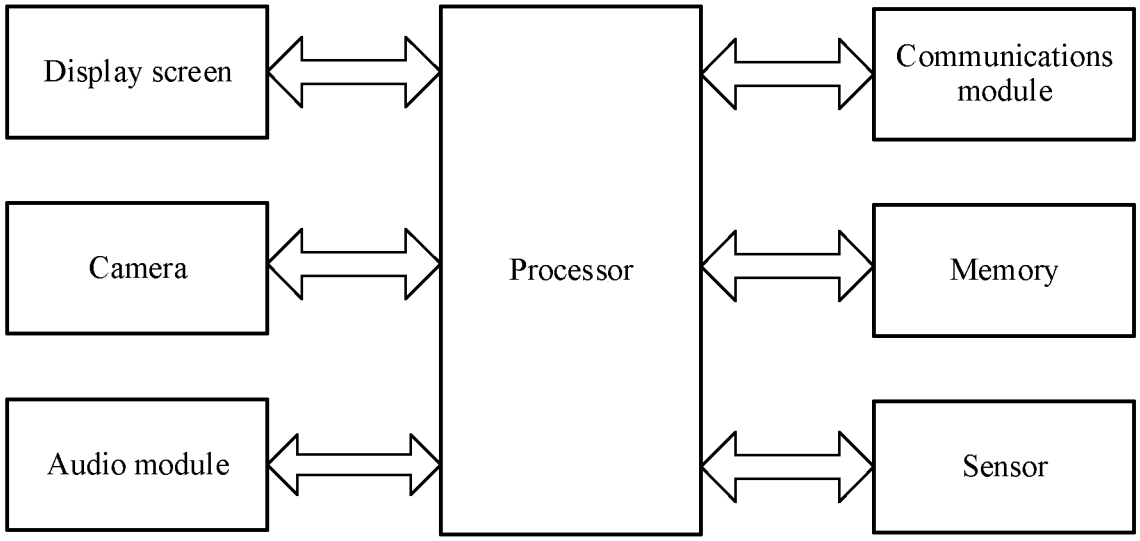
FIG. 9 is a schematic structural diagram of an electronic device according to an embodiment of the present disclosure.

Based on the foregoing embodiments, FIG. 9 is a schematic structural diagram of an electronic device according to an embodiment of the present disclosure. As shown in FIG. 9, the electronic device may include a processor, a memory, a display screen, a camera, an audio module, a communications module, and a sensor, and the processor is connected to the memory, the display screen, the camera, the audio module, the communications module, and the sensor. The memory may be a read-only memory (ROM) or a random-access memory (RAM), and is configured to store program code and data required for execution by the processor. The display screen includes the screen module disclosed above, and is configured to present a user interface to the outside. The camera is configured to take photos. The audio module may be a microphone or a speaker, and is configured to play or receive audio signals. The communications module is a wireless communications module, and may include WI-FI, BLUETOOTH, global positioning system (GPS), and the like. The sensor may include an acceleration sensor, a gyroscope, an ambient light sensor, a distance sensor, a fingerprint sensor, or the like, and is configured to detect a posture of the mobile phone, an ambient environment, or the like. The processor is connected to the DDIC circuit in the screen module for sending to-be-displayed data to the DDIC circuit.

The objectives, technical solutions, and benefits of the present disclosure are further described in detail in the foregoing specific embodiments. It should be understood that the foregoing descriptions are merely specific embodiments of the present disclosure, but are not intended to limit the protection scope of the present disclosure. Any modification, equivalent replacement, or improvement made within the spirit and principle of the present disclosure shall fall within the protection scope of the present disclosure.

What is claimed is:

1. A screen module of an electronic device and comprising:

a screen pixel array comprising a plurality of rows of pixels and a plurality of columns of pixels, wherein the screen pixel array is configured to display to-be-displayed data;

a first plurality of row lines coupled to the screen pixel array;

a first plurality of column lines coupled to the screen pixel array;

a display driver integrated circuit (DDIC) circuit configured to be disposed in a first non-display area on a side of the electronic device and comprising a plurality of output channels, wherein the DDIC circuit is configured to output the to-be-displayed data;

a gate driver on array (GOA) circuit disposed in a second non-display area on an upper edge of the electronic device or in the second non-display area on a lower edge of the electronic device, coupled to one of the first column lines, and configured to sequentially strobe each of the columns of the pixels;

a switch circuit disposed on the first non-display area and comprising a plurality of switches, wherein each of the switches comprises a first input end and a first output end, wherein the first output end of each of the switches is coupled to one of the first row lines, wherein each of the output channels is coupled to input ends of a first switch and a second switch of the switches, wherein two of the switches that are coupled a same output channel are coupled to an odd row line in the first row lines and an even row line in the first row lines, and wherein the switch circuit is configured to:

receive the to-be-displayed data from the DDIC circuit;

control two of the switches coupled to a same output channel in the DDIC circuit to alternately operate based on an enabling signal; and send the to-be-displayed data to the screen pixel array through the first row lines; and an enabling signal circuit coupled to the switch circuit, wherein the enabling signal circuit comprises a frequency-halving divider coupled to the DDIC circuit, the GOA circuit, and the switch circuit, wherein the frequency-halving divider is configured to perform frequency-halving on a first clock signal of the DDIC circuit, wherein the first clock signal is after the frequency-halving, is an enabling signal and is a second clock signal of the GOA circuit, and wherein the enabling signal circuit is configured to:

generate the enabling signal; and send the enabling signal to the switch circuit.

2. The screen module of claim 1, wherein the switch circuit further comprises two switch sub-circuits, wherein a first switch sub-circuit comprises a second plurality of switches and a second switch sub-circuit comprises a third plurality of switches, wherein each of the output channels is coupled to one of the second switches and one of the third switches, wherein the switch circuit is further configured to control the two switch sub-circuits to alternately operate based on the enabling signal.

* * * * *